US009345365B1

(12) United States Patent
Welles et al.

(10) Patent No.: US 9,345,365 B1
(45) Date of Patent: May 24, 2016

(54) APPARATUS FOR MAINTAINING A PERSON IN A WARM STATE WHILE SHOWERING

(71) Applicants: Linda B. Welles, Elmira, NY (US); Andrew V. Welles, Horseheads, NY (US); Richard V. Welles, Elmira, NY (US); Steven B. Welles, Brooklyn, NY (US); Thomas S. Welles, Elmira, NY (US)

(72) Inventors: Linda B. Welles, Elmira, NY (US); Andrew V. Welles, Horseheads, NY (US); Richard V. Welles, Elmira, NY (US); Steven B. Welles, Brooklyn, NY (US); Thomas S. Welles, Elmira, NY (US)

( * ) Notice: Subject to any disclaimer, the term of this patent is extended or adjusted under 35 U.S.C. 154(b) by 566 days.

(21) Appl. No.: 13/631,376

(22) Filed: Sep. 28, 2012

(51) Int. Cl.
*A47K 3/28* (2006.01)

(52) U.S. Cl.
CPC ..... *A47K 3/28* (2013.01)

(58) Field of Classification Search
CPC ..... A47K 3/287; A47K 3/28; B05B 1/207; A61G 7/0005; A47D 7/00
USPC ..... 4/601, 604, 615–618, 585
See application file for complete search history.

(56) References Cited

U.S. PATENT DOCUMENTS

| | | | | | |
|---|---|---|---|---|---|
| 536,020 | A | * | 3/1895 | Ebert | 4/618 |
| 550,665 | A | * | 12/1895 | Whitcomb | 4/618 |
| 638,348 | A | * | 12/1899 | Melchers | 4/618 |
| 1,318,172 | A | * | 10/1919 | Patrick | 4/618 |
| 1,957,956 | A | * | 5/1934 | Hardy et al. | 4/618 |
| 2,015,377 | A | * | 9/1935 | Callander | 4/618 |
| 2,757,384 | A | * | 8/1956 | Slater | 4/601 |
| 3,040,335 | A | * | 6/1962 | Gellmann | 4/570 |
| 3,677,263 | A | * | 7/1972 | Allen | 601/17 |
| 3,979,096 | A | | 9/1976 | Zieger | |
| 4,150,445 | A | * | 4/1979 | Bailey | 4/546 |
| 4,160,292 | A | | 7/1979 | Kuether et al. | |
| 4,346,485 | A | | 8/1982 | Reed et al. | |
| 4,425,672 | A | | 1/1984 | Johnson et al. | |
| 4,899,402 | A | | 2/1990 | Maynard et al. | |
| 4,964,573 | A | * | 10/1990 | Lipski | 239/283 |
| 5,054,471 | A | | 10/1991 | Ohlson | |
| 5,065,462 | A | | 11/1991 | Romano | |
| 5,285,539 | A | | 2/1994 | Anderson et al. | |

(Continued)

FOREIGN PATENT DOCUMENTS

CH 677181 4/1991

OTHER PUBLICATIONS

Dennis, Helen, SeniorTruth, H.E.L.P., Dementia and Bathing, web printout at http://help4srs.org/seniortruth/?p=76, 2010.

(Continued)

*Primary Examiner* — Tuan N Nguyen
*Assistant Examiner* — William R Klotz
(74) *Attorney, Agent, or Firm* — Kenneth J. Lucacher Law Group

(57) ABSTRACT

An apparatus is provided having a diverter member attachable to a shower water supply pipe for passing warm water along first and second paths, and a distributor coupled to the diverter member for receiving water via conduit(s) along the first path, in which the distributor is retained in a water dispersion member to enable positioning of the distributor over at least over the shoulders of the person. The distributor has holes to distribute water onto the upper body of the person, via the dispersion member. The diverter member can be coupled to a handheld showerhead to provide water along a second path to the showerhead to enable showering of the person while the water is continuously being provided along the first path via the distributor via the openings to maintain the person in a warmed state. Flow of water may be controllable separately along the first and second paths.

29 Claims, 8 Drawing Sheets

(56) References Cited

U.S. PATENT DOCUMENTS

| | | | | |
|---|---|---|---|---|
| 6,237,167 | B1 * | 5/2001 | Hunden | 4/567 |
| 6,374,434 | B1 | 4/2002 | Reid | |
| 6,418,573 | B1 | 7/2002 | Masuda | |
| 6,516,477 | B1 | 2/2003 | Storm | |
| 6,641,057 | B2 * | 11/2003 | Thomas et al. | 239/104 |
| 6,920,654 | B2 | 7/2005 | Noguchi et al. | |
| 7,055,188 | B2 | 6/2006 | Ross et al. | |
| 7,299,510 | B2 | 11/2007 | Tsai | |
| 2004/0060107 | A1 | 4/2004 | Eisenberg | |
| 2009/0094737 | A1 | 4/2009 | Tracey | |

OTHER PUBLICATIONS

Donahue, Alzheimer's problems with Bathing, web printout at http://caregiverrelief.wordpress.com/2010/01/02/alzheimers-problems-wb-n/, 2010.

Kennard, Christine, Caregiver Tips: Washing and Bathing Someone with Alzheimer's Disease, About.com. Alzheimer's / Dementia, web printout at http://alzheimers.about.com/od/practicalcare/a/Wash_Bath.htm, Nov. 9, 2006.

BetterHealth Channel, Fact Sheet, Dementia and personal hygiene, web printout at http://www.betterhealth.vic.gov.au/bhcv2/bhcarticles.nsf/pages/Dementia_and_personal_hygiene?. . . , printed Jun. 16, 2012.

Premier Care Walk-in Bath, Smartsource Magazine, Advertising Supplement to Rochester Democrat & Chronicle, News Corp. Co., Jun. 3, 2012.

HOV Tips on Bathing the Elderly & Dementia Care, Personal Care, Hospice of the Valley, web printout at http://www.hov.org/personal_care.aspx, 2011.

Dementia Care Central, Preparing for Bath Time, web printout at http://www.dementiacarecentral.com/node/539, printed Jun. 16, 2012.

Alzheimer's Society, Washing and Bathing, web printout at http://alzheimers.org.uk/site/scripts/documents_info.php?documentID=155, printed Jun. 16, 2012.

Alzheimer's Association, Bathing, Caregiver Center, web printout at http://www.alz.org/care/alzheimers-dementia-bathing.asp, printed Jun. 16, 2012.

Alzheimer Society of B.C.—Bathing, web printout at http://www.alzheimerbc.org/getdoc/d42188ef-0f0c-43fb-b7b3-0b5019eeeadb/Bathing.aspx, printed Jun. 16, 2012.

AbleData, Whirlpool Bathtub, web printout at http://www.abledata.com/abledata.cfm?pageid=19327&ksectionid=19327&top=10489, printed Jun. 16, 2012.

Larkin, Alzheimer's Reading Room, How to Get an Alzheimer's Patient to Bathe, web printout at http://www.alzheimersreadingroom.com/2011/04/how-to-get-alzheimers-patient-to-bathe.html, 2011.

Waterpik NSC 659 6-Mode Handheld Shower with Opti-Flow, Brushed Nickel, web printout from Amazon.com, printed May 31, 2012.

Medline Industries, Handheld Shower Head, SKU MDSHHSHOWER, web printout from www.medline.com, May 31, 2012.

FCA: Caregiver's Guide to Understanding Dementia Behaviors, web printout from http://www.caregiver.org, 2004.

Waterpik, Instruction Manual, 2010.

Chrome Handheld Shower Head with Shut Off Flow Control Switch by Zoe, web printout from Amazon.com, printed May 31, 2012.

EmpowerMate—Automated Seated Shower System, Empowermate Systems, Inc., screen capture of video at web site http://www.dailymotion.com/video/xml0mb_empowermate-automated-seated-shower-system_lifestyle, Nov. 26, 2011.

Smart Products Inc., Smart Talk, Issue 114, Oct. 2010.

Oasis Automated Seated Power System, Empowermate Systems, Inc., Jun. 2012, as displayed at website http://www.vetsaccessllc.com/Catalog/Online-Catalog-Product/22207/Best-Bath-Oasis-Automated-Seated-Shower-System.

Oasis Automated Seated Power System, Empowermate Systems, Inc., Jun. 2012, as discussed at web address http://empowermate.com/images/Oasis%20Benefit%20Discussion.pdf.

* cited by examiner

APPARATUS FOR MAINTAINING A PERSON IN A WARM STATE WHILE SHOWERING

FIELD OF THE INVENTION

The present invention relates to an apparatus for maintaining a person in a warm state while showering. The apparatus is installable onto a shower water supply pipe and can facilitate warming of a person while utilizing a handheld showerhead. The apparatus is particularly useful for caregiver showering of an elderly or handicapped person who may be seated in a chair in a shower or combination shower-bathtub to avoid the person undesirably feeling chilled while a caregiver is showering the person. When warming of a person by the apparatus is not needed, normal shower operation may be provided without requiring detachment of the apparatus from the shower water supply pipe.

BACKGROUND ON THE INVENTION

Elderly, handicapped, or other person with limited mobility, routinely require a caregiver, to properly shower in a stall, shower, combination shower-bathtub, or other showering facilities, in a bathroom, or in healthcare facility, such as a hospital, nursing home, rehabilitation center, or the like. The caregiver is typically a nurse, aid, or a family member. During showering, the person being showered by the caregiver often experiences an undesirable chill as water from shower cools (and/or evaporates) upon the skin of the person. This effect can be exacerbated by air flow about the person, which can occur by caregiver movement in the shower. This chill can cause distress upon elderly or handicapped in the shower due to limited or reduced mental capacity, such as due to dementia or Alzheimer's, believing that the caregiver is attempting to do harm. This distress can sometimes lead to the person attempting to leave the shower prior to completion by the attending caregiver or result in lashing out by the person which can harm the caregiver or the person. Further, even after showering, the person will often resist future showering experience by caregivers or a particular caregiver to avoid the negative experience that was a result of feeling chilled. Thus, it would be desirable to avoid a person receiving a shower by a caregiver from experiencing a chill on his or her skin.

SUMMARY OF THE INVENTION

Accordingly, it is the primary object of the present invention to provide an apparatus that avoids a person receiving a chill during showering by a caregiver.

Another object of the present invention is to provide an apparatus that provides both warming of a person during caregiver showering while the caregiver carries out the process of showering the person, or warming of the person prior to caregiver showering.

A further object of the present invention is to provide an apparatus attachable to shower plumbing that enables warming of a person during or prior to caregiver showering in a shower, and at other times allows normal use of the same shower while the apparatus is attached thereto.

A still further object of the present invention is to provide an apparatus enabling a caregiver to shower a person easily without use of another hose or sprayer which may be present in the shower.

Briefly described, the apparatus embodying the present invention has a diverter member attachable to a shower supply water pipe for passing water (e.g., warm temperature water) when provided from the supply water pipe along a first path and a second path, and a distributor coupled to the diverter member for receiving water via one or more conduits along the first path. Such conduit(s) may be of plastic (e.g., PVC), metal, or other piping material for conveying water, and preferably such conduit(s) include at least a flexible hose between the diverter member and distributor. The distributor is disposed in a flexible water dispersion member to retain the distributor at a position at least over the shoulders of a person, such that holes or openings along the distributor enable water to flow, via the dispersion member, onto the person in order to keep the person warmed by water provided along the first path. The diverter member enables coupling of the apparatus to a showerhead to provide water along a second path to such showerhead so as to enable showering of the person while being warmed by water provided along the first path. Thus, the person (seated or standing) wearing the dispersion member upon at least his or her shoulders may be warmed and then maintained in a warm state by water provided from the distributor, via the dispersion member, while being showered by a user of the apparatus using the showerhead. The user of the apparatus may be either a caregiver, or the same person wearing the dispersion member if able to shower him or herself without caregiver assistance.

The apparatus further has a flow control device provided by a valve along the first path (e.g., in the path of water flow via first path conduit(s)). Water flow along the first path is controlled by the caregiver (or person wearing the dispersion member) by changing the position of the valve to open, close, or positions there between, such as by a manual lever, knob, switch, slide or other valve position controller coupled to the valve. Optionally, warming of the person by passing water along the first path via the distributor member can occur prior to operation of the showerhead to shower the person, and then the valve may be closed during showering and later opened as needed if warming of the person is desired.

The showerhead is preferably a typical handheld showerhead having a handheld showerhead wand, a flexible hose, and a receiving member attachable to the diverter member of the apparatus, via a coupler if needed, to enable water to pass along the second path to the showerhead wand, via the receiving member and the hose coupled between the showerhead wand and the receiving member. The showerhead also preferably has a flow control device provided by a switch to control the flow of water from the showerhead when supplied along the second path, such switch may be part of the showerhead wand. This switch when open (or at least partially open) allows water from the supply water pipe to flow along the second path from the showerhead, and when closed causes all the water from the supply water pipe to flow along the first path when the valve is set to enable such first path flow. The switch may also be the same or similar to the flow control device present along the first path. It is thus preferred that the user of the apparatus can separately control flow of water along the first and second paths of the apparatus.

Thus, the apparatus may be operable in multiple modes:

a first mode to enable simultaneous showering of the person via the showerhead by water flowing along the second path, and warming of the person by water flowing along the first path via the distributor and dispersion member (i.e., both valve and showerhead switch is set by a user to enable water flow to the dispersion member and showerhead, respectively);

a second mode to enable non-simultaneous showering and warming by dispersion member (i.e., only one of the valve or the showerhead switch is set by a user to enable water flow at a time); and a third mode where the valve is closed to enable normal showering by water flowing along the second path from the showerhead (i.e., when the person showering does not require warming by first path water).

The distributor may be a flexible tube having closed ends and multiple openings along its length with an input port in the middle of the apparatus's flexible tube to enable attachment to the flexible hose along the first path. The dispersion member is preferably of an absorbent fabric material, such as cotton, having a surface to cover the skin of the person along a person's shoulders, and partially down along the person's upper arms, back and front. A pocket in the back of the dispersion member may receive the flexible tube of the distributor so that the input port extends through an opening in the pocket for connection to the flexible hose along the first path.

The apparatus is directed for use when the person showering needs warmth provided by first path water apart from any warmth received from second path flowing water that may be provided by a showerhead in a shower. When not in use, the portion of the apparatus having the distributor with or without the dispersion member may be hung, such as by its flexible hose, on a hook (or hooks) along a wall of a shower or combined shower-bathtub, thereby facilitating normal use of the shower via the second path with the valve along the first path in a closed position without possible obstruction by that portion of the apparatus. Preferably, the dispersion member is separable from the distributor, so as to facilitate replacement or cleaning of the dispersion member.

Optionally, a mechanism may be provided which is attachable to the back of a chair upon which the person is seated for supporting the apparatus upon the person by the apparatus's flexible hose.

BRIEF DESCRIPTION OF THE DRAWINGS

The foregoing and other objects, features and advantages of the invention will become more apparent from a reading of the following description in connection with the accompanying drawings in which.

DETAILED DESCRIPTION OF THE INVENTION

Figure 1:
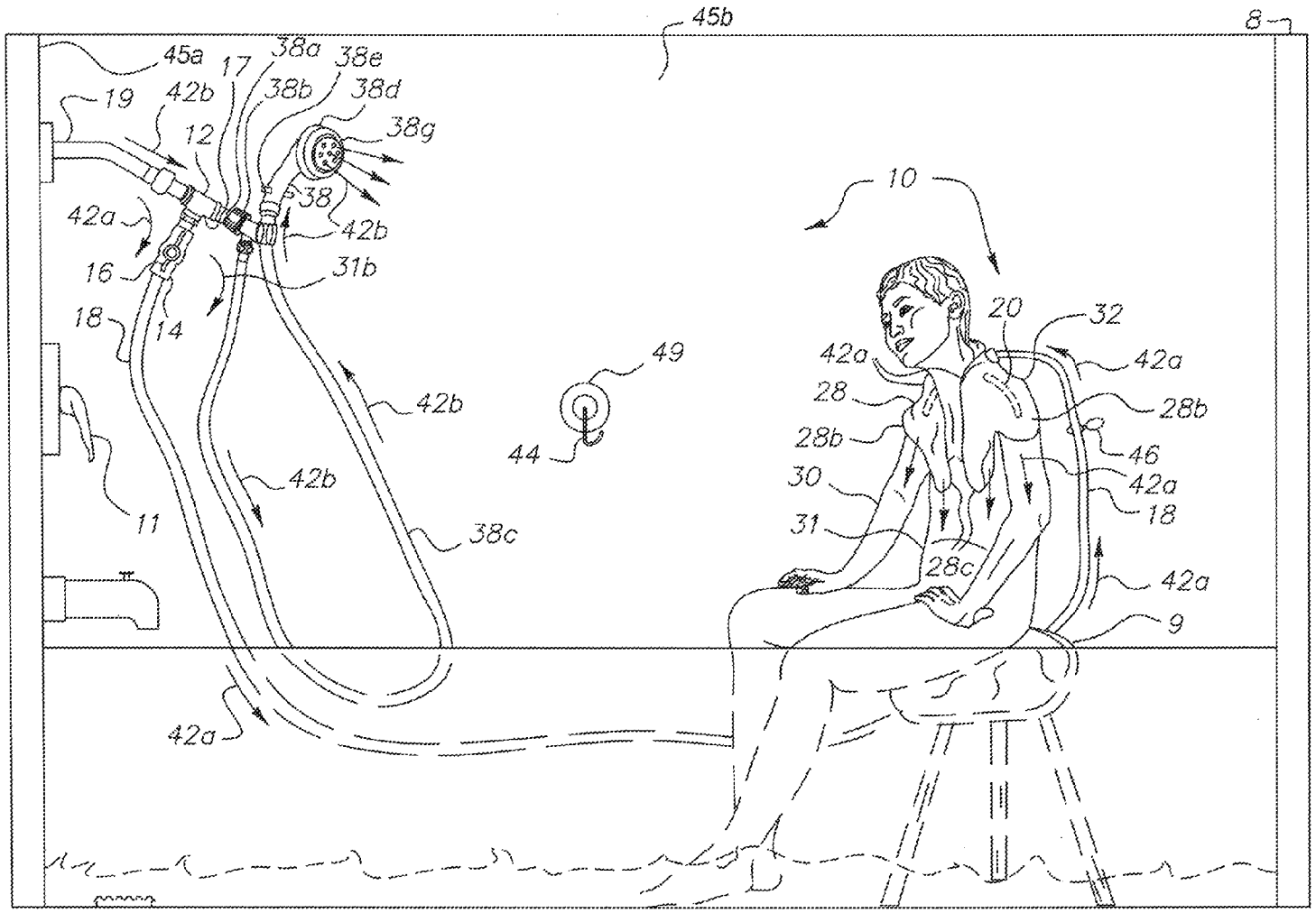
FIG. 1 is a perspective view of the apparatus of the present invention as installed for example in a combination shower-bathtub showing the person to be showered or being showered seated with the apparatus's distributor held within a flexible water dispersion member draped over the individual's shoulders around the neck and upon back and front of the person's body.

Referring to FIGS. 1, 2A, 2B, 3A and 3B, the apparatus 10 of the present invention has a diverter member 12, and a flow control device provided by a ball valve 14. Diverter member 12, commonly referred to as a tee, has two opposing open ends 13*a* and 13*b*, and one side open end 13*c*, where open end 13*a* is attachable to a shower water supply pipe 19 to receive water therefrom so that the diverter member 12 diverts the water received to open ends 13*a* and 13*c*. Such attachment is enabled by open end 13*a* being internally threaded so that an externally threaded end of a water supply pipe 19 can screw into open end 13*a* and thus secured to the water supply pipe 19. Ball valve 14 has two open ends 15*a* and 15*b*. Ball valve 14 is coupled to the diverter member 12 by a coupler 17, commonly referred to as male end nipple, since ball valve open end 15*a* and diverter member open end 13*c* are both internally threaded. Coupler 17 has a first externally threaded end 17*a* which is tightened into open end 13*c*, and ball valve open end 15*a* is tightened in a second externally threaded end 17*b* of coupler 17. Water sealant may be applied near the end 17*a* of coupler 17 to assure a sealed interface between coupler 17 and diverter member 12. Apparatus 10 is shown assembled in FIG. 1 and in an exploded view in FIG. 3A.

Water supply pipe 19 represents any supply pipe that commonly extends into a shower or combination shower-bathtub 8, such as from a wall 45*a*, but apparatus may be used on any typical showerhead threaded for receiving open end 13*a* of diverter member 12.

Figure 4A:
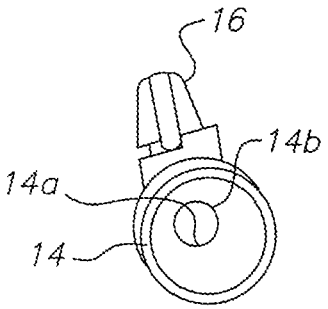
FIGS. 4A, 4B, and 4C are perspective views of the ball valve of FIG. 1 with the valve in open, partially open/closed, and closed positions, respectively.
Figure 4B:
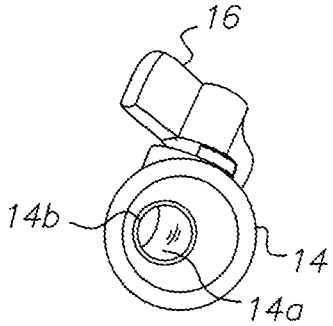
Figure 4C:
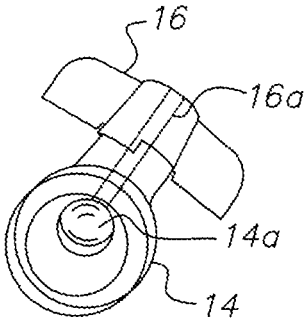

Ball valve 14 has a flow controller or lever 16 which rotates a shaft 16*a*, as depicted by arrow 16*b* (FIG. 3A) to turn a ball 14*a* in a pathway between the ball valve's ends 15*a* and 15*b*, which in turn positions an aperture 14*b* extending through ball 14*a*. By turning flow controller 16, the valve 14 can be in open and closed position, or partially open/closed, where the valve is shown open in FIG. 4A to enable water flow via aperture 14*b* (lever 16 parallel to the longitudinal axis of ball valve 14 between ends 15*a* and 15*b*). The valve 14 is shown closed in FIG. 4C with ball 14*a* positioned to occlude any flow through valve 14 (lever 16 rotated orthogonal to the longitudinal axis of ball valve 14—see arrow 16*b*). The valve 14 is shown in FIG. 4B partially open/closed to illustrate one of intermediate positions between open and closed to adjust the flow of water through aperture 14*b* between full open and closed valve positions. Although ball valve 14 is preferred, other types of valves or flow control devices may be used (e.g., same or similar to later described showerhead switch 38*e*).

Diverter member 12 may be made of rigid CPVC or metal, and ball valve 14 may be a typical PVC ball valve, such as manufactured by Mueller Global (e.g., Model No. 107-533HN), or Kentsharp Co., Ltd. Optionally, diverter member 12 and valve 14 may be a single unit, rather than an assembly of parts. Less preferably, diverter member 12 and ball valve 14 may be replaced by a single diverter valve unit which controls flow either to open end 13*b* or 15*b*.

Apparatus 10 further has a distributor 20 coupled to ball valve 14 via a flexible hose 18. Hose 18 may be a typical metal or plastic tube, preferably at least 72 inches in length, having a first externally threaded connector 19*a* which is tightened to secure into internally threaded ball valve end 15*b*. Distributor 20 has a flexible tube 21, such as of plastic material, with a plurality of spaced holes (or openings) 22 like a sprinkler. The two ends 23 of tube 21 are each closed by a cap 24. Tube 21 may be a plastic corrugated tube, but such tube may be non-corrugated. Preferably the tube 21 has a degree of flexibility, but the tube may be rigid or formed part of a rigid distributor assembly. An input port 26 is provided by a cylinder, such as of PVC, mounted to tube 21 about an opening 25 formed about the middle of tube 21, such that water may pass through the input port's opening 27 in communication with opening 25 to holes 22. A cement or other adhesive may join the non-threaded end of the input port 26 to tube 21 about opening 25. Input port 26 may be provided by a plastic male nipple connector. The external threading along input port 26 enables screw-on attachment to internally threaded connector 19*b* of hose 18. Caps 24 may be of rubber or plastic and frictionally engage ends 23 of tube 21 or joined thereto, such as by cement or other adhesive. Input port 26 and tube 21 may be molded together with or without closed ends. Components 12, 14, 17, 18, 20, 26, of apparatus 10 may each be ½ inch in interior diameter. The tube 21 on either side of input port 26 may represent two legs of the distributor 20 positionable at least over a person's shoulders 32 along the back of the person's neck, where each of the holes 22 enable outflow of water to flow onto the body 31 of a person 30 when water is provided via openings 25 and 27 of distributor 20. Such positioning is facilitated by a dispersion member 28 described below. Tube 21 may be a single conduit, or the distributor's two legs may be provided by two coupled conduits, where more than two conduits may be provided if desired.

Figure 2A:
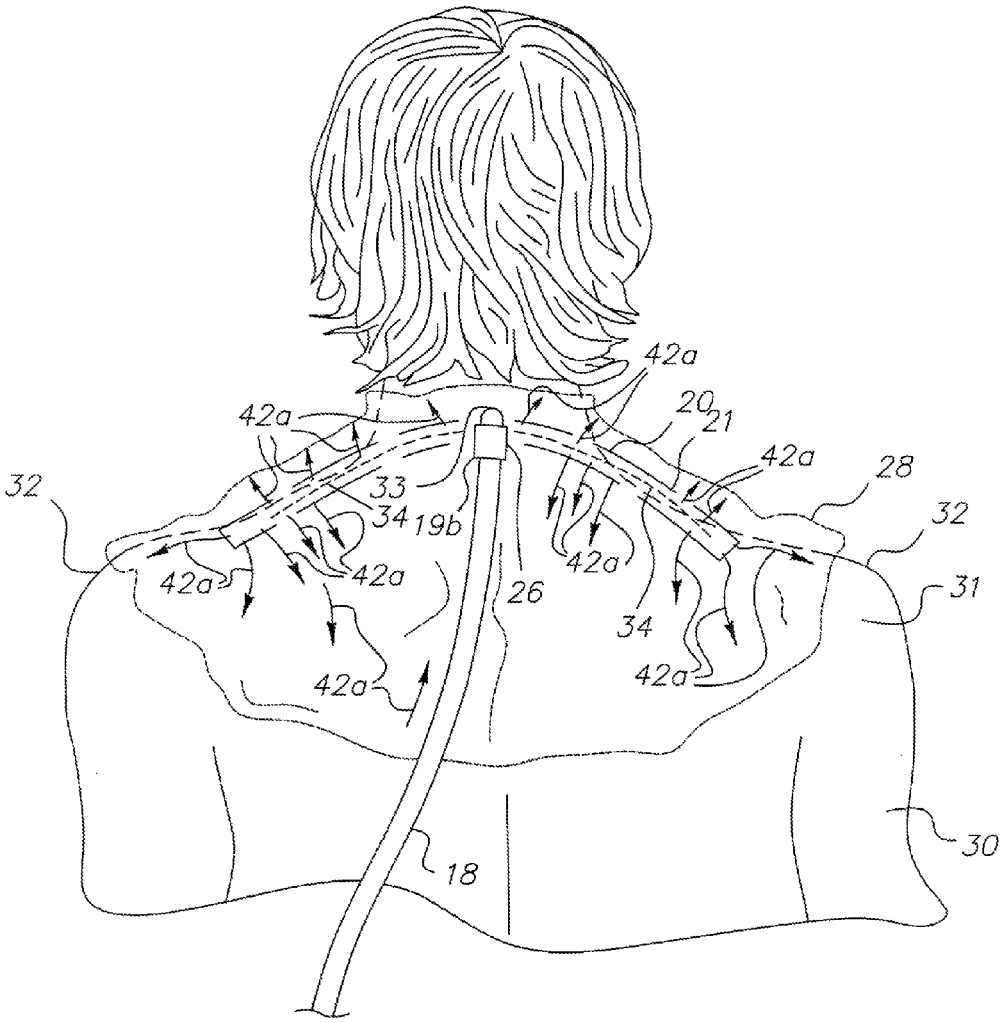
FIG. 2A is a partial perspective view of the upper back of the person of FIG. 1 showing the water dispersion member with part of the distributor within the dispersion member shown in dashed lines.

To retain the distributor 20 with respect to the body 31 of person 30, apparatus 10 has a flexible water dispersion member 28 into which distributor 20 is disposed, and member 28 can then contact the shoulders and upper arms, back, and front of a person depending on the size of dispersion member 28. When the distributor 20 is positioned in member 28, tube 21 extends along the back of the person's neck and then either side of tube 21 along the right and left shoulders 32 of the person 30, as best shown in FIG. 2A in dashed lines. The dispersion member 28 is shown along the front of the person 30 in FIG. 2B. Dispersion member 28 may be composed of water absorbent material that disperses water received via distributor 20 by first absorbing the water, and then when saturated enables water to disperse there from down along the body 31 of person 30. Thus, dispersion member 28 may be considered water permeable as well, or even partially absorbent so long as water from dispersion member 28 is applied to the skin of person 30 in contact with dispersion member 28, and if desired flow away from dispersion member 28 along the person's body 31 adjacent but not in direct contact with dispersion member 28. The distributor 20 is positioned in dispersion member 28 so that holes 22 are directed to completely soak dispersion member 28 with applied water via holes 22. Holes 22 preferably enable water to extend outward from distributor 20 in a plurality of directions to enable water to soak the entire dispersion member 28, such as for example, one or more rows of spaced pin holes 22 similar to those used in a garden sprinkler along the distributor's tube 21. Optionally, distributor caps 24 may also have one or more of holes 22.

The material of dispersion member 28 may be cotton fabric, such as terry cloth, or fleece, but other water absorbing fabrics or non-fabric material may be used that can disperse water from distributor 20 as desired upon the skin of person 30. Optionally dispersion member 28 may be non-absorbent, such as flexible plastic with multiple dispersion openings formed along its lower surface which is positionable upon person 30 in a similar manner to that shown in FIGS. 1 and 2. These dispersion openings may be in proximity to each other to permit adequate water dispersion upon the skin of the person 30.

Figure 3A:
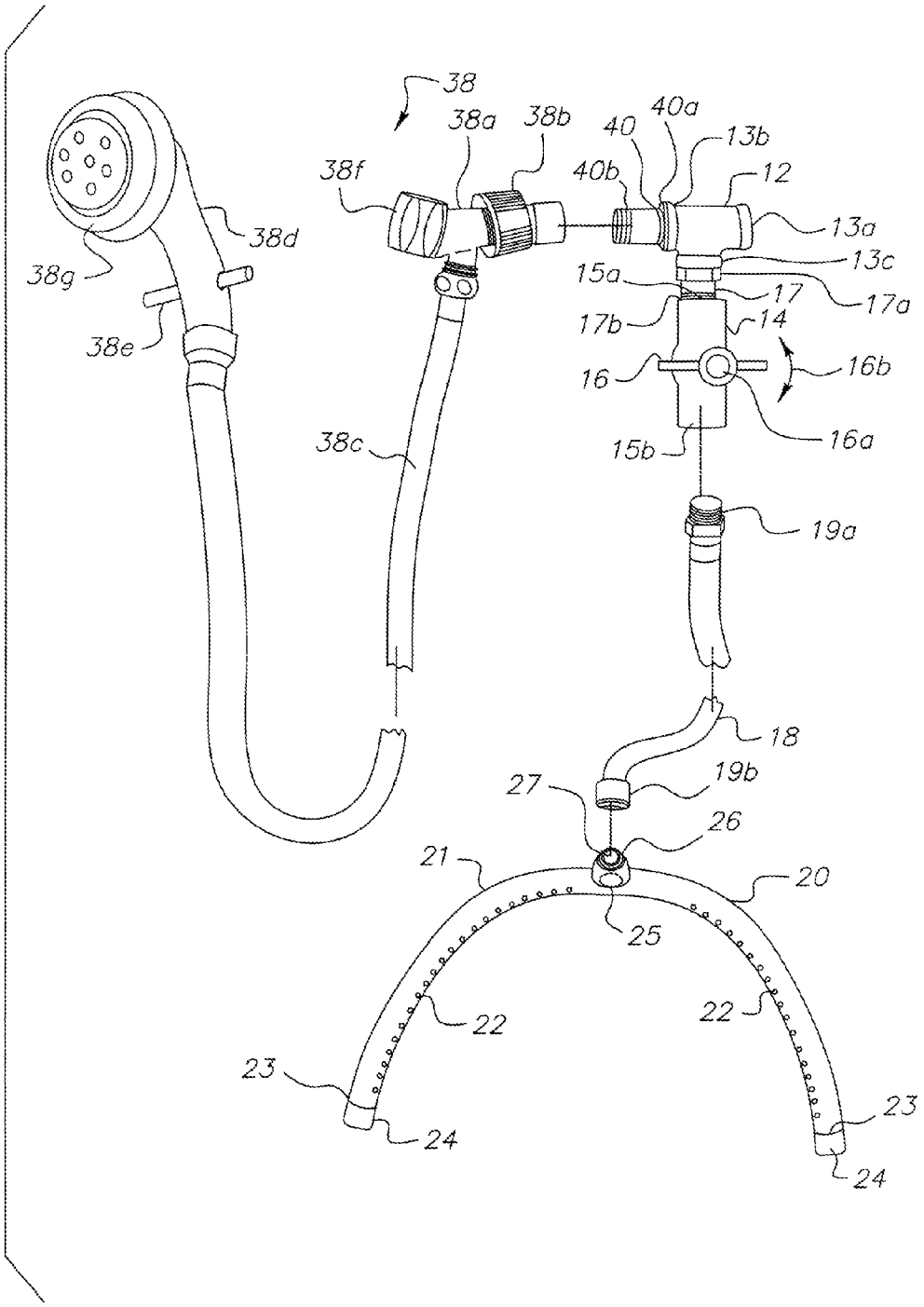
FIG. 3A is an exploded view of the apparatus of FIG. 1 without the water dispersion member.
Figure 3B:
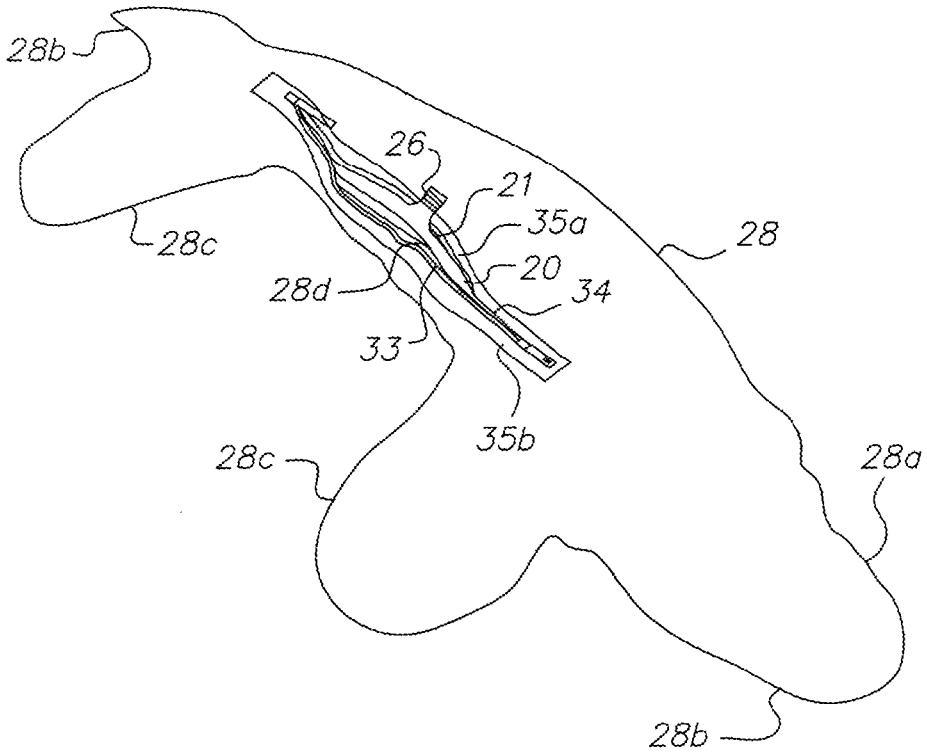
FIG. 3B is a perspective view of the water dispersion member of FIGS. 1 and 2 oriented along a flat surface with its pocket shown for example partially opened to receive the distributor.

Referring to FIG. 3B, dispersion member 28 is of two cut pieces of fabric joined (stitched) together along their outer edges 28*a*, and having right and left side extensions 28*b* and right and left front extensions 28*c* continuous with the back of edge 28*a*, so that dispersion member 28 can be positioned around a person's back so as to cover the upper portion of the back, and extensions 28*b* extend along and over the right and left shoulders, and front extensions 28*c* extend downward along body 31 along the upper part thereof. An opening 33 is provided in dispersion member 28 along one of the pieces of fabric to enable access to a pocket 28*d* formed between the two fabric pieces, so that distributor 20 may be positioned therein with input port 26 extending from pocket 28*d* sufficient for coupling to hose 18. A closure mechanism is provided along opening 33 to retain distributor 20 in dispersion member 28, such as by a zipper mechanism 34 having interlockable teeth attached along the opening's two opposing sides 35*a* and 35*b*, and two zipper sliders which can zip close from each of the sides 35*a* and 35*b*, respectively, until near input port 26. The zipper mechanism 34, shown as a dashed line in FIG. 2A, thus closes pocket 28*d* about the opening 33 through which the distributor's input port 26 is connected to hose 18 via the hose's connector 19*b*. Alternatively to zipper mechanism 34, Velcro, buttons, or loops may be used, or less preferably the distributor 20 is permanently sewed to dispersion member 28. In a further alternative, the opening 33 is round with an elastic band which may be stretched to insert distributor 20, and then when relaxed input port 26 extends there through.

Providing a closure mechanism that enables the distributor 20 to be releasable there from has the benefit of removing the distributor for washing the dispersion member 28 when needed. Although the particular shape of dispersion member 28 as shown in the figures is preferred, other shapes, such as rectangular, may be used which are sufficient to disperse water from distributor 20 along the upper body 31 of the person 30.

Dispersion member 28 may alternatively be provided by a single fabric piece in order to reduce the weight of member 28 when wet. In this case, pocket 28*d* may then be formed limited in back of member 28 by stitching fabric with an opening 33 sufficient to form a pocket sized to receive distributor 20. A closure mechanism to capture distributor 20 may similarly be provided.

The diverter member 12 of apparatus 10 is attachable to a showerhead 38 so that water from shower supply pipe 19 can flow through openings 13*a* and 13*b* of member 12 to the shower head 38. A coupler 40 which is similar to coupler 17 is provided to enable such attachment. Coupler 40 has a first externally threaded end 40*a* which is tightened into open end 13*b* of diverter member 12.

Showerhead 38 may be any typical handheld showerhead which is designed for coupling onto a typical end of a water supply pipe 19 of a shower. Different types of handheld showerheads are available from home improvement or hardware stores, such as handheld manufactured by Water Pik, Inc. Any handheld shower unit mountable onto a typical shower supply pipe 19 may also be used to mount onto diverter member 12 via a second threaded end 40*b* of coupler 40.

Although handheld showerheads come in different designs that may be used with apparatus 10, generally a typical handheld showerhead 38 includes a nut 38*b* at one end of flow receiver 38*a*, where the nut 38*b* threads onto threaded end 40*b* of coupler 40 and tightened thereto in the same manner as showerhead receiver 38*a* would attach to a common water supply pipe extending into a shower. Receiver 38*a* is open along a bottom side for connection to a hose 38*c* attached to a handheld showerhead wand 38*d*. This enables water to flow through receiver 38*a* via hose 38*c* to showerhead wand 38*d*, which when not handheld is positionable in bracket 38*f* and removable there from when needed. Typically, receiver 38*a* is pivotal so as to adjust the position of the showerhead wand 38*d* when present in bracket 38*f*. A water sealant may be applied near each of coupler ends 40*a* and 40*b* to assure a sealed interface between diverter member 12 and coupler 40, and coupler 40 and receiver 38*a*, respectively.

Preferably, showerhead 38 has a flow control device shown by a switch (button or slide) 38*e* in wand 38*d* for controlling water flow via openings 38*g* of wand 38*d* and thereby enable and disable (shut off) flow of water from the showerhead, as desired. The showerhead wand 38*d* with switch 38*e* may be one as manufactured by Medline with or without hose 38*c*, or are available from Zoe Industries with an on-off (or adjustable flow control) switch built into the showerhead. Less preferably, the flow control device may be provided by a valve similar to ball valve 14 between hose 38*c* and receiver 38*a*. The user operable flow control device provided by switch 38*e* has the benefit such that when set to shut off flow through showerhead 38, and valve 14 is in an open position (or at one or more positions between open and closed position), all water flow from water supply pipe 19 can flow to the distributor 20 and then onto person 30 through dispersion member 28. Optionally, switch 38*e* may adjust the flow of water via showerhead 38 between full on and full shut off as well as providing an on/off flow control device.

Other types of showerheads than shown may be coupled to member 12 via coupler 40 which are not handholdable (with or without a user operable flow control device), but such is not desirable since it makes it difficult for the purpose of showering of a person who may be seated in a chair 9, or even by a person without such caregiver.

Apparatus 10 provides a person 30 warm temperature water via water supply pipe 19. Such temperature of water via water supply shower pipe 19 may be adjusted via handle or knobs 11 typically present in a shower (e.g., stall shower) or combination shower-bathtub 8 suitable for keeping the person warm when such water is distributed by distributor 20 upon the person. The range of suitable water temperature may depend on the person, but may be in the range of 100-110 degrees (° F.), depending on his or her sensitivity.

The apparatus 10 has two paths for water from the water supply pipe 19. The first path 42*a*, as depicted by labeled arrows in FIG. 1, is enabled when the ball valve 14 is open, i.e., ball valve 14 is open by fully rotating lever 16 to an open/on position (FIG. 4A), or to a partial open position (FIG. 4B) when to adjust for a lower amount of first path water flow than if fully open. Water can then flow along a first path 42*a*, i.e., through water supply pipe 19, open ends 13*a* and 13*c* of diverter member 12, coupler 17, ball valve 14, hose 18, to distributor 20 and then out of distributor holes 22 to dispersion member 28 for dispersion of the water along the upper body 31 of person 30. Holes 22 are located along tube 21 of distributor 20 so that when tube 21 is properly positioned around over the back of the person and along his/her shoulders 32, holes 22 are located and of size to enable generally uniform sprinkling of water onto dispersion member 28 so that both the back, front and upper arms of the person 30 receive warm water and such warm water may then drip from the dispersion member 28 down upon other lower parts of the person. Water flow through apparatus 10 along path 42*a* may be at 2 gallons per minute depending on the rate water is received via shower pipe 19.

The second path 42*b* as depicted by labeled arrows in FIG. 1, i.e., through water supply pipe 19, open ends 13*a* and 13*b* of member 12, coupler 40, through receiver 38*a*, hose 38*c*, and showerhead wand 38*d* when wand switch 38*e* is in its open, on, or enabled position. Water pressure via supply pipe 19 enables water to flow along both first and second paths 42*a* and 42*b* when ball valve 14 is open or at least partially open so that simultaneous warming of the person 30 and showerhead operation can be achieved if desired. The portion of flow along the path 42*a* may be adjusted by the extent of ball valve 14 is between open and closed positions. When switch 38*e* is closed, off, or disable position, water flow from showerhead wand 38*d* is stopped, and the second path flow 42*b* ceases, and water will only flow along the first path 42*a* if ball valve 14 is open or at least partially open. Control of ball valve 14 position is by turning lever 16 as described earlier. If showerhead switch 38*e* is closed, off, or in disable position, and ball valve 14 is in the closed position, flow of water along both first and second paths 42*a* and 42*b* ceases. As stated earlier, a switch 38*e* or other flow control device may be provided that enables the user to adjust the flow of water via showerhead 38 between full on and full shut off as well as providing an on/off flow control.

Figure 5A:
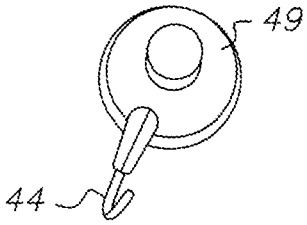
FIGS. 5A and 5B are front and back perspective views, respectively, of a wall hook of FIG. 1 for holding part of the apparatus extendable to the person when use of the distributor is not needed so as to enable normal use of the shower by others.
Figure 5B:
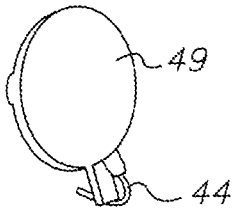

When the portion of the apparatus 10 having the distributor 20 and dispersion member 28 is not in use with respect to person 30, they may be hung together along wall 45*b* by a loop 46 coupled to hose 18 being received on wall hook 44 (FIG. 1) located on the side wall 45*b* (or wall 45*a*), or other wall of the shower or combined shower-bathtub 8 or shower area. Such loop 46 may be a rubber or plastic material looped around hose 18, and hook 44 is secured to wall 45*b* so as to support the weight of distributor 20 and dispersion member 28 and hose 18. Multiple ones of hook 44 and loop 46 or other releasable holder mechanism may be provided along wall 45*b*. If needed distributor 20 may be removed from the pocket 28*d* of dispersion member 28 prior to being hung so that a fresh one of dispersion member 28 may be disposed onto the distributor 20 prior to next use of the apparatus, or to facilitate drying or washing of dispersion member 28. As shown in FIGS. 5A and 5B, hook 44 is preferably releasably attached to wall 45*b* by a suction cup 49 attached to hook 44, which can be pressed against the surface of wall 45*b* to secure the suction cup to the wall, where suction cup 49 is removable there from by releasing the suction, if needed.

Method of installation of apparatus 10 is as follows. Apparatus 10 is assembled by connecting diverter member 12, ball valve 14, hose 18 their associated couplers and connectors, together such as shown in FIG. 1. Diverter member 12 at its open end 13*a* is mounted onto the shower water supply pipe 19 as described earlier, and then showerhead 38 via its receiver 38*a* is attached to the other end 13*b* of diverter member 12 via coupler 40 as described earlier. The distributor 20 is placed in pocket 28*d* of flexible dispersion member 28, as shown in FIG. 3B, and pocket 28*d* is closed until the opening to the pocket is limited to about input port 26, and input port 26 is then connected to hose 18. Thus when water is provided along first path 42*a* onto a person as described earlier, dispersion member 28 blocks direct conveyance of water from such holes 22 of distributor 20 onto the person. Wall hook 44 is located along a shower wall to hang part of apparatus 10 as described earlier, if desired.

Figure 2B:
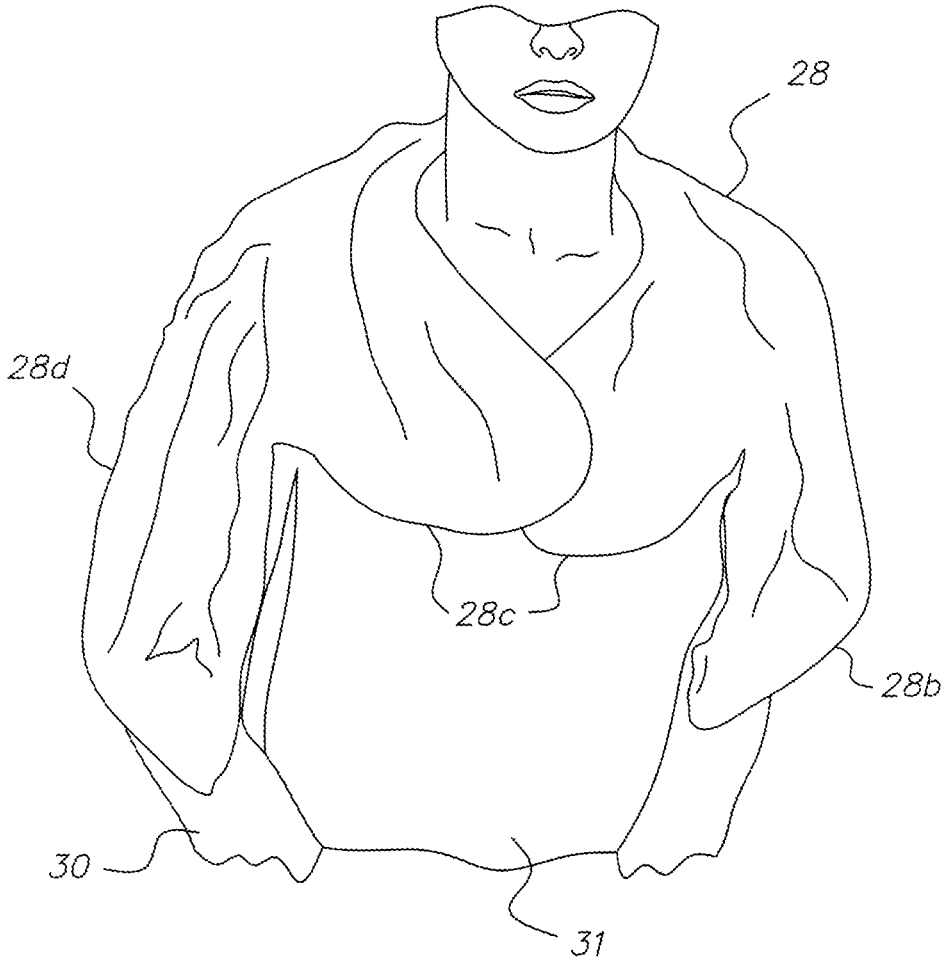
FIG. 2B is a partial perspective view of the front portion of the person of FIG. 1 showing the water dispersion member.

Method of use of installed apparatus 10 is as follows. A caregiver is typically present who will assist a person 30 and facilitate showering thereof and operate apparatus 10, as well as showerhead wand 38*d* and its switch 38*e*. However, a person may use apparatus 10 without a caregiver. The person 30 is positioned on a chair 9, or a seat which may be built into the wall(s) of the shower or combination shower-bathtub 8, or outside of the shower next to the shower. With lever 16 turned so that valve 14 is in the open or partially open position, water is then turned on in the shower or combination shower-bath 8 using knobs or control lever 11 to a comfortable showering temperature, i.e., desired warm temperature, by a caregiver prior to showering person 30. For example, this may be by either feeling the water via showerhead 38 with switch 38*e* on, or in the case of a combination shower-bath by feeling water via a bathtub water supply pipe prior to actuating a typical bath-to-shower change over device, e.g., switch or lever, to change water flow to shower water supply pipe 19. Once water temperature is adjusted as desired, the person 30 enters the shower 8 (or shower area) if not already present, and the distributor 20 with dispersion member 28 is placed (or worn) over the skin of the shoulders of the person 30 so as to extend around the person's back of the neck and along the top of shoulders, such as shown in FIGS. 1, 2A and 2B. Optionally, hose 18 is not connected to input port 26 until after distributor 20 is disposed in dispersion member 28 and positioned onto the person 30.

With lever 16 turned so that valve 14 is open or at least partially open (e.g., FIG. 4A or 4B) the water flowing via path 42*a* is absorbed by dispersion member 28 thereby soaking dispersion member 28 until no more water can be absorbed and water flows (outflows) from dispersion member 28 down onto the part of the body not covered by dispersion member 28. If dispersion member 28 is not of water absorbent material, it also disperses (spreads) water from distributor 20 to locations along the person. Optionally, lever 16 may be slowly turned to move valve 14 towards its closed position (or valve positions between full open and closed positions) until a desired flow of water via valve 14 is obtained flowing through distributor 20 to dispersion member 28.

Next, with showerhead switch 38*e* on or enabled, the caregiver uses the showerhead wand 38*d* of the shower head to shower the person 30 as would normally be performed without apparatus 10 being worn by the person, thereby enabling simultaneous mode of use of the showerhead 38 via water along path 42*b* and continuous warming of the person's body 31 via water along path 42*a*, thereby avoiding the problem of the person 30 feeling cold or receiving a chill as applied warm water from the showerhead 38 cools (and/or evaporates) upon the body of the person 30 during showering. If needed, dispersion member 28 (or parts thereof) may be raised or moved at times to soap and rinse. Hose 18 is of sufficient length, e.g., 72 inches, to reach the upper back of the person 30 when seated, while hose 38*c* is of sufficient length, e.g., 84 inches, to enable use of showerhead wand 38*d* to reach different area of the body of the person as typical of handheld showerhead use by an attending caregiver.

A non-simultaneous mode may instead be carried out, in which prior to start of showering, lever 16 is turned to close valve 14 and water along path 42*a* ceases once dispersion member 28 is fully soaked by water from distributor 20, and then showering with water along path 42*b* is performed using wand 38*d*. This mode is possible when dispersion member 28 once soaked with warm water can keep the body 31 of the person warm during showering. Of course, if during showering of person 30 he or she complains of feeling cold or receiving a chill, the apparatus may then be operated in a simultaneous mode, or switched between simultaneous and non-simultaneous modes, as needed, until the person obtains again the feeling or perception of warmth on their skin.

After showering is completed, water from shower supply pipe 19 is disabled by controller or lever 11 being turned to an off position, with or without first turning off one or more of valve 14 or showerhead switch 38*e*. The apparatus 10 may then hung on wall hook 44 as described earlier. Dispersion member 28 may be allowed to dry or removed from distributor 20, and rinsed or washed for later use. Different sizes of dispersion members 28 may be provided for use with different size persons.

For normal use of the shower or combined shower-bathtub, the first path 42*a* is shut off by ball valve 14 being in a close position (FIG. 4C) so that all water from water supply pipe may flow along the second path 42*b* to showerhead 38.

Apparatus 10 may be sold in a kit or package with at least diverter member 12, ball valve 14, hose 18, distributor 20, and dispersion member 28. Couplers 17 and 40 may be provided as part of the kit or such male nipples may be already incorporated as part of ball valve 14 and/or diverter member 12, or ball valve and member 12 having their respective open end adapted for proper coupling without need for couplers 17 and 40. Such conduits provided along path 42*a* to the distributor 20 (which preferably includes at least a flexible portion provided by hose 18) may be provided by other piping or plastic (e.g., PVC), metal, or other material for conveying water. Less preferably, a single conduit along path 42*a* may be provided coupled or connected between diverter member 12 and distributor 20, rather than multiple conduits coupled or connected to each other. Although apparatus 10 is designed to retrofit or adapt a shower or combined shower-bathtub to utilize the present invention, showerhead 38 and its' associated parts may also be included in the kit.

The person 30 being showered by a caregiver may be seated, standing, or in another position while wearing dispersion member 28. Further although it is preferable that the distributor 20 and water dispersion member 28 are two separate components which may be coupled together for enabling apparatus 10, alternatively the function of the water permeable dispersion member 28 and distributor 20 may be combined in a single flexible water distributor unit that can be disposed to rest upon the upper parts of the body of a person while showering similar to that shown by dispersion member 28.

Figure 6A:
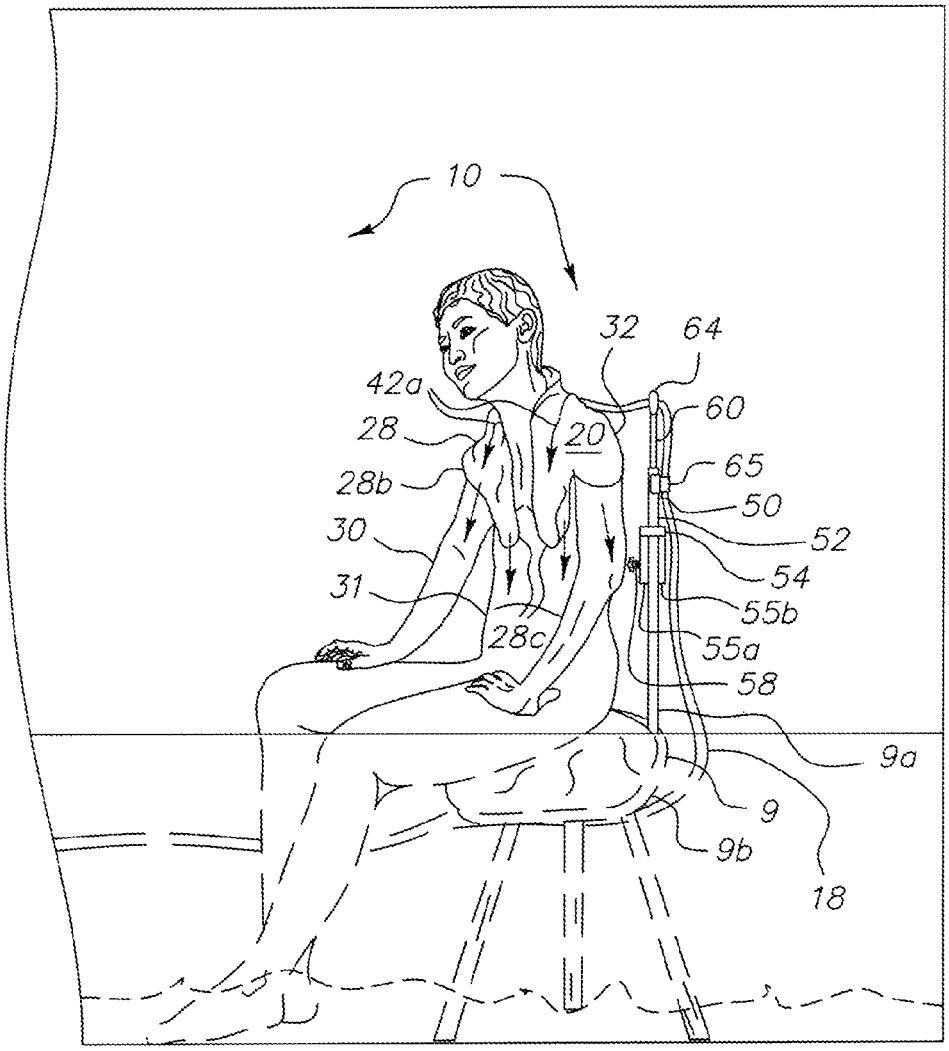
FIG. 6A is a perspective view of part of the apparatus of FIG. 1 showing the apparatus with the person on a chair having an upright back portion and a back support mechanism attached thereto for supporting a portion of the apparatus from behind the seated person.
Figure 6B:
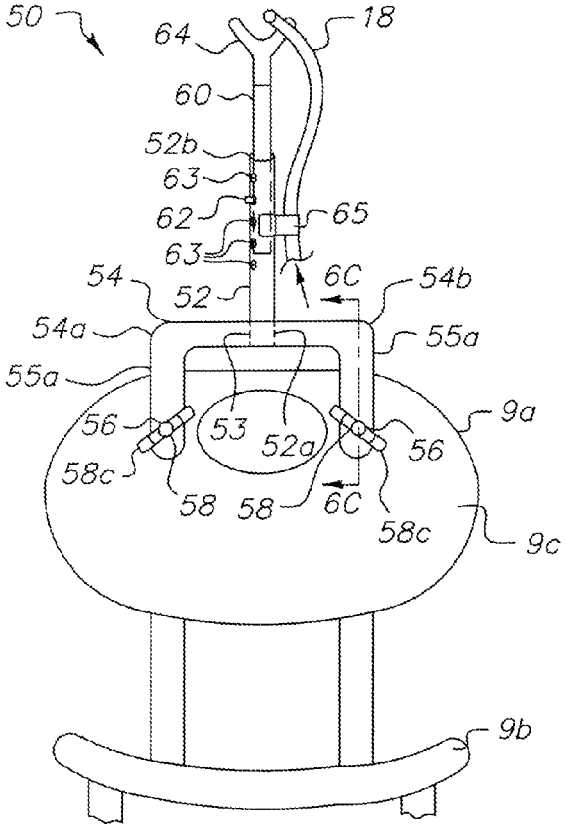
FIG. 6B is a front view of part of the chair of FIG. 6A with the back support mechanism.
Figure 6C:
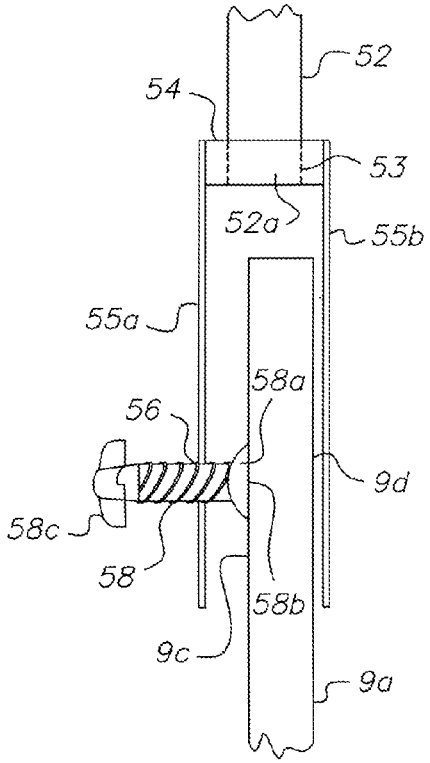
FIG. 6C is a partial cross-sectional view of the back support mechanism of FIG. 6B.

Referring to FIGS. 6A, 6B, and 6C, an optional back support mechanism 50 is shown when person 30 is seated on chair 9 having an upright back portion 9*a* extending from the chair's seat portion 9*b*, as typical of some types of bath chairs. Back support mechanism 50 has a cylinder 52 extending upwards from a base or plate 54. Extending from each of ends 54*a* and 54*b* of base 54 is a front flange 55*a* and back flange 55*b*. Between each pair of flanges 55*a* and 55*b* is received the back portion 9*a* from the top thereof. A clamp 58 is threaded to be received in a threaded hole 56 extending through the front flange 55*a*. To attach support mechanism 50 to the chair 9, the end 58*a* of the clamp has a surface 58*b* which applies force against the front surface 9*c* of the back portion 9*a* as the clamp's wing nut 58*c* is tightened and back flange 55*b* lies against the back surface 9*d* of the back portion 9*a*, as shown in FIG. 6C. Tightening both clamp members 58 thus clamps back support mechanism 50 to chair 9.

Cylinder 52 has one end 52*a* which is fixed into a hole or bore 53 in base 54, and an open end 52*b* into which is received a cylinder 60, e.g., cylindrical tube or shaft, that is slidable in cylinder 52. Attached to the top of cylinder 60 is a plastic or rubber Y shaped member 64.

When attached by the two clamps 58 to chair back portion 9*a*, the height of Y shaped member 64 is adjustable by sliding cylinder 60 with respect to cylinder 52. Cylinder 60 may be releasably fixed with respect to cylinder 52 such as by a spring bias button 62 which can be received in one of a plurality of spaced holes 63 along outer wall of cylinder 52. The base 54, cylinders 52 and 60, flanges 55*a* and 55*b* may be made of metal or plastic.

With the Y shaped member 64 slightly higher than the top of shoulders 32 of person 30 as shown for example in FIG. 6A, hose 18 extend along the Y shaped member 64 and attaches to distributor 20 retained in dispersion member 28. Further, a ring clip 65 attaches hose 18 to cylinder 52 as the hose extends along the back side of support mechanism 50. The back support mechanism 50 thus slightly lifts upward hose 18 as shown in FIG. 6A to assist in maintaining the distributor 20 and dispersion member 28 in position on person 30 during use of apparatus 10. The back support mechanism 50 may also support part of the weight of distributor 20 and dispersion member 28 if the weight is uncomfortable for person 30 wearing the dispersion member 28 such as shown in FIG. 6A. This may especially be useful when water is flowing along path 42*a* of apparatus 10 and the weight of distributor 20 and dispersion member 28 increases from its dry state as it saturates with water. Such increased weight may found uncomfortable to a person 30 during use of apparatus 10 to keep the person warm. Although cylinders 52 and 60 are shown, other telescopic adjustable mechanisms than mechanism 50 may be used to adjust the height of member 64. Further, cylinders 52 and 60 and base 54 may be part of the back portion 9*a* and extendible there from, or the function of mechanism 50 may be provided instead by back portion 9*a* height being increased to a level so that the top to back portion 9*a* may support hose 18 in a similar manner to member 64.

Although hose 18 is shown separate from chair 9, the part of the hose 18 leading to distributor 20 may be built into or attached along the chair seat portion 9*b* and/or back portion 9*a*, and as such may be considered separate conduit(s) along path 42*a* connectable to hose 18 and distributor 20 for passing water. Further, if another water supply pipe than pipe 19 is present in the shower area, optionally the apparatus's hose 18 (or other coupled conduit(s)) with or without flow control device (e.g., ball valve 14) may be connected to such alternative water supply pipe, thereby leaving pipe 19 connected to a typical showerhead. Further, although apparatus 10 is described for use with warm temperature water, the apparatus may be used with other temperature water, such as cold, if needed to cool down a person having an elevated body temperature.

From the foregoing description, it will be apparent that an apparatus for a shower for maintaining a person in a warm state while said person is showering and method of using same has been provided. Variations and modifications of the herein described apparatus, attachment, kit, and method for implementing the invention will undoubtedly suggest themselves to those skilled in the art. Accordingly the foregoing description should be taken as illustrative and not in a limiting sense.

The invention claimed is:

1. A device for distributing water onto the body of a person comprising:

a distributor for receiving water and having a plurality of openings; and a water dispersion member positionable in contact with the person along at least the shoulders of the person, said openings of said distributor distribute water to said dispersion member for dispersing said water upon the person; wherein said dispersion member blocks direct conveyance of water from said openings onto the person during use; and said dispersion member comprises fabric material which when upon the person is configured to absorb water from said openings of said distributor until after saturation of the fabric material enables flow of water from said dispersion member onto the person during use.

2. The device according to claim 1 wherein said distributor comprises one or more conduits having said openings, said conduits being positionable in said water dispersion member so that said openings provide water for dispersion by the dispersion member in contact with the person.

3. The device according to claim 1 wherein said distributor receives water from a water supply pipe in a shower or bath via one or more conduits.

4. The device according to claim 3 wherein said one or more conduits have a manually operable flow control device.

5. The device according to claim 3 wherein at least one of said one or more conduits are attached or built into a chair.

6. The device according to claim 3 further comprising means for coupling a portion of said water from said water supply pipe to said distributor and another portion of said water from said supply pipe to a showerhead.

7. The device according to claim 6 wherein said showerhead is a handheld shower head.

8. The device according to claim 6 wherein said portion of said water flowing to said distributor and to said another portion flowing to said showerhead are separately controllable.

9. An apparatus for maintaining a person in a warm state while showering comprising:

means for passing water from a supply water pipe along a first path and a second path;

means having a plurality of openings locatable upon at least the shoulders of a person during use for distributing water from said first path upon said person when water is provided along said first path, wherein said means locatable upon at least the shoulders of the person further comprises means for dispersing said water upon the person; said means for dispersing blocks direct conveyance of water from said openings onto the person, wherein said means for dispersing comprises fabric material configured to absorb water received until after saturation thereof enables flow along said first path onto at least the shoulders of the person; and means for showering said person using water from said second path when water is provided along said second path.

10. The apparatus according to claim 9 further comprising means for enabling a user to separately adjust flow of water along each of said first and second paths.

11. An apparatus attachable to a shower water supply pipe to maintain a person in a warm state while showering comprising:

a diverter member attachable to a shower supply water pipe for passing warm temperature water when provided from the supply water pipe along a first path and a second path;

a distributor coupled via one or more conduits to said diverter member for receiving water along said first path, in which the distributor has a plurality of openings to distribute water onto the upper body of the person when water is provided along said first path via a dispersion member positionable upon at least the shoulders of a person; wherein said dispersion member blocks direct conveyance of water from said openings onto the person during use, wherein said dispersion member comprises fabric material configured to absorb water from said distributor until after saturation of the fabric material enables flow of water from said dispersion member onto the person during use; and said diverter member when coupled to a showerhead provides water along said second path to the showerhead to enable showering of the person while said water is being provided along said first path via said openings of said distributor to maintain the person in a warmed state while showering.

12. The apparatus according to claim 11 wherein said one or more conduits have a valve along said first path for controlling the flow of water along said first path, said valve having an open position, a closed position, and one or more positions between said open position and said closed position, for adjusting flow of water along said first path to said distributor, wherein said valve when in said closed position disables flow of water from said water supply pipe along said first path.

13. The apparatus according to claim 11 wherein said dispersion member is positionable in contact with the person along the shoulders of the person, and part of the upper front, upper back, and upper arms of the person, said dispersion member retains said distributor to enable positioning of said distributor over at least the shoulders of a person so that said openings distribute water onto the dispersion member for dispersing said water along the shoulders of the person, and part of the upper front, upper back, and upper arms of the person when water is provided along said first path.

14. The apparatus according to claim 11 wherein said diverter member enables coupling to the showerhead comprising a flexible hose, a hand-holdable shower wand, and a receiving member attachable to said diverter member to enable water to pass along said second path to said receiving member and to said shower wand via said flexible hose.

15. The apparatus according to claim 14 wherein said showerhead has a flow control device along said second path to control flow of water from openings of said shower wand when supplied along said second path, in which water flow from said water supply pipe is disable along said first path via said showerhead when said flow control device is closed.

16. The apparatus according to claim 15 wherein said apparatus is operable in a first mode to enable simultaneous showering of the person via said showerhead by water along said second path and warming of the person by water along said first path by said valve and said flow control device both enabling flow of water there through, and in a second mode in which only one of said valve and said flow control device at any one time enables flow of water there through.

17. The apparatus according to claim 11 further comprising means along one or more of said first path and said second path for separately controlling flow of water along said respective path.

18. The apparatus according to claim 11 wherein said one or more conduits represent a first one or more conduits, and said distributor comprises a second one or more conduits having said openings along its length, and an input port coupled to said second one or more conduits.

19. The apparatus according to claim 18 wherein said dispersion member is coupled to said distributor in which said second one or more conduits are positionable in said dispersion member to retain the distributor is a position at least over the shoulders of a person by said dispersion member being in contact at least with the shoulders of a person, in which said openings along the distributor enable water along the first path to flow via the dispersion member onto the person.

20. The apparatus according to claim 11 wherein said supply water pipe extends into a shower area having a plurality of walls, and said apparatus further comprises one or more hooks coupled to one of said walls for holding a part of said apparatus having said distributor when not positioned over the shoulders of a person, thereby enabling non-obstructed normal use of the shower or combination shower-bathtub when water is provided via said second path.

21. The apparatus according to claim 12 wherein said apparatus is operable in a first mode to enable simultaneous showering of the person via said showerhead by water along said second path and warming of the person by water along said first path, and in a second mode wherein water provided along said second path by said valve is closed after said valve is in an open position or one or more of positions between open and closed to enable warming along the skin of the person by water along said first path via said dispersion member.

22. The apparatus according to claim 11 wherein said one or more conduits includes at least a flexible hose connected to the distributor.

23. The apparatus according to claim 22 further comprising means attachable to a part of a chair upon which the person is seated for supporting the apparatus upon the person by said flexible hose.

24. The device according to claim 1 wherein said fabric material of said dispersion member is shaped to drape around the neck, over the shoulders, and then downward below the shoulders to cover along at least an upper chest, upper back, and upper arms of the person.

25. The device according to claim 1 wherein said dispersion member has a pocket formed of said fabric material for receiving one or more portions of said distributor having said openings.

26. The device according to claim 25 which said pocket has a closure mechanism for retaining said one or more portions of said distributor in said pocket, and said pocket has an opening for a conduit to provide water to said one or more portions of said distributor.

27. A wearable device for maintaining a person in a warm state while showering comprising:

a distributor having a plurality of openings for conveying warm water; and a flexible member comprising fabric material which is shaped along both shoulders of a person wearing the flexible member during use, and downward from the shoulders to cover at least the upper chest, upper back, and upper arms of the person, and said flexible member is configured to receive the water via said openings and apply said received water along the person to maintain the person in a warm state, wherein said flexible member is disposed between said openings and the person; wherein said flexible member blocks direct conveyance of water from said openings onto the person.

28. The device according to claim 27 wherein said flexible member is composed of flexible material enabling absorption of water in response to water provided via said openings until saturated from said water to warm the skin of the person in contact with said flexible member and enable flow of warm water via said flexible member onto the person.

29. The device according to claim 27 wherein said flexible member holds at least a portion of said distributor to enable positioning of said openings of the distributor over at least the shoulders of a person so that the flexible member disperses the water received from said openings along the shoulders of the person, and at least the upper chest, upper back, and upper arms of the person when water is conveyed to said distributor.

* * * * *